US005443401A

United States Patent [19]

Champion et al.

[11] Patent Number: 5,443,401

[45] Date of Patent: Aug. 22, 1995

[54] ELECTRICAL CONNECTOR FOR MOTHER AND DAUGHTER PRINTED CIRCUIT BOARDS

[75] Inventors: Patrick Champion; Jacky Thenaisie both of Le Mans, France

[73] Assignee: Framatome Connectors International, France

[21] Appl. No.: 331,143

[22] Filed: Oct. 27, 1994

Related U.S. Application Data

[63] Continuation of Ser. No. 16,637, Feb. 12, 1993, abandoned.

[30] Foreign Application Priority Data

Feb. 13, 1992 [FR] France ..... 92 01618

[51] Int. Cl.[6] ..... H01R 13/64

[52] U.S. Cl. ..... 439/680; 439/79

[58] Field of Search ..... 439/78, 79, 80, 83, 439/680, 694, 607, 677, 680, 681

[56] References Cited

U.S. PATENT DOCUMENTS

| | | | |
|---|---|---|---|
| 3,614,714 | 10/1971 | Silverstein | 439/680 |
| 4,365,857 | 12/1982 | Watanabe et al. | 439/79 |
| 4,531,795 | 7/1985 | Sinclair | 439/152 |
| 4,533,203 | 8/1985 | Feldman et al. | 439/79 |
| 4,693,531 | 9/1987 | Raphal et al. | 439/680 |
| 4,740,697 | 6/1978 | Van Son | 439/680 |
| 4,773,881 | 9/1988 | Adam, III | 439/681 |
| 5,090,912 | 2/1992 | Zell | 439/79 |
| 5,277,624 | 1/1994 | Champion et al. | 439/609 |

FOREIGN PATENT DOCUMENTS

| | | | |
|---|---|---|---|
| 392629 | 10/1990 | European Pat. Off. . | |
| 3603250 | 8/1987 | Germany . | |
| 0088289 | 4/1991 | Japan | 439/680 |

*Primary Examiner*—Gary F. Paumen
*Assistant Examiner*—Hien D. Vu
*Attorney, Agent, or Firm*—Andrus, Sceales, Starke & Sawall

[57] ABSTRACT

This invention relates to a connection set for electrically connecting a mother card (1) and a daughter card (2), comprising a first connector (3) including a first insulating body (10) which presents first contact members (60) of which first ends (63) are inserted in the mother card (1) and a second connector member (5) including a second insulating body (81) which presents second contact members (85) of which respective first ends (83) cooperate with corresponding ends (62) of respective one of the first contact members (60) and of which second ends (88) are inserted in the daughter card, respective surfaces (31, 41)) of the first (3) and the second (5) insulating bodies facing each other when the first (3) and second (5) connector members are connected together. It comprises a spacer member (44) which maintains a predetermined distance between the two facing surfaces (31, 41), of the first (10) and second (81) insulating bodies so that the edge (61) of the daughter card (6) remains spaced apart from the first insulating body (10).

7 Claims, 4 Drawing Sheets

ELECTRICAL CONNECTOR FOR MOTHER AND DAUGHTER PRINTED CIRCUIT BOARDS

The present application is a continuation application of U.S. patent application Ser. No. 08/016,637, filed Feb. 12, 1993, and now abandoned.

BACKGROUND OF THE INVENTION

The present invention relates to a connector for electrically connecting a mother circuit board with a daughter circuit board.

A connector is known from the prior art for connecting electrically a mother card (backplane) and a daughter card, comprising a first connector member including a first insulating body presenting first contact elements of which a first end is adapted for insertion in the mother card and a second connector member comprising a second insulating body presenting second contact elements of which first ends are adapted to cooperate with second ends of the corresponding ones of the first contact elements and of which second ends are adapted to be inserted in the daughter card, respective connection faces of the first and second insulating bodies facing each other when the first and second connectors members are connected together.

This connector assembly is only usable for at most two different thicknesses of daughter card. However, more different thicknesses of circuit board exist, for example 1,6 mm, 2,4 mm and 3,2 mm. It is not currently possible to provide connectors for all these different possible cases with a single width of connector, which implies that standardisation of the connectors is not possible, leading to disadvantages due to the manufacturing costs of connectors of different width and the requirement to keep stocks of different types of connectors. This makes the usage of such connectors less for printed circuits of greater thickness (3,2 mm in the example quoted above).

An object of the invention is to avoid the above disadvantages.

Another object of the invention is to provide a connector system enabling larger printed circuit board thicknesses to be accommodated.

A more specific object of the invention is to enable a standard distance to be maintained between the end of the daughter card and a reference plane of the mother card even with daughter cards of increased thickness.

SUMMARY OF THE INVENTION

These and other objects of the invention which will be apparent from the following detailed description, drawings and claims are achieved by a connector set of the above kind, in which the connector set comprises spacer means for maintaining a predetermined distance between said facing surfaces of said first and said second insulating bodies so that the extreme end of the daughter card remains spaced from the first insulating body when the connector set is connected together.

Preferably, said spacer means also forms a physical check means preventing incorrect assembly of said connection set.

In one embodiment of the invention, said spacer means comprises an insert member in at least one of said insulating bodies.

In another embodiment of the invention, said spacer means comprises at least one projection which is an integral part of at least one of said facing faces.

One of said insulating bodies presents a central part and two lateral branches, an internal face of said central part forming one of said facing faces.

In a preferred embodiment of the invention, said extreme end of the daughter card is of reduced thickness.

This allows in particular to space apart the second connector member from the first connector member so that the first row of contacts of the daughter board is located in the full thickness region thereof.

One of said lateral branches may present an outer end having a recess disposed on its internal face facing said extreme end of the daughter card. Said extreme end of the daughter card may be of reduced thickness. Said predetermined distance may be such that, when said first and second connector members are connected together, a full thickness edge of the daughter card is disposed in immediate proximity to said outer end. One lateral face of the second insulating body may thus present maintaining means for said reduced thickness extreme end of the daughter card.

Said full thickness edge may be disposed in immediate proximity to said connection elements so that the daughter card is efficiently maintained on the second insulating body which avoids the strains on the second extreme ends of the second connection elements.

The predetermined distance may be such that, when said first and second connectors members are connected together, a full thickness edge of the daughter card is disposed in immediate proximity to said outer end of said lateral branch.

BRIEF DESCRIPTION OF THE DRAWINGS

Other features and advantages of the invention will appear from the following description of embodiments thereof, given by way of example with reference to the accompanying drawings, in which.

DESCRIPTION OF THE PREFERRED EMBODIMENTS OF THE INVENTION

Figure 1:
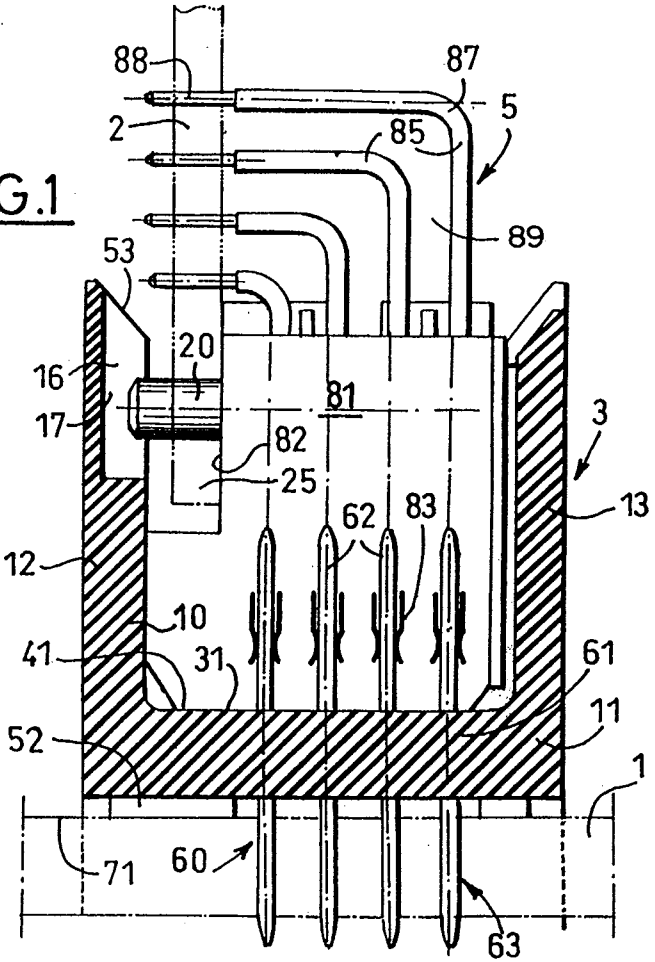
FIG. 1 PRIOR ART
FIG. 1 is a part sectional elevation view of a prior art connector.

FIG. 1 shows a connector according to a prior art design for orthogonal electrical connection between a mother circuit board (or backplane) and a daughter circuit board. The connector set comprises a male part 3 having an insulating body 10 whose profile is in a flattened U-shape and a female part 5 having a central insulating body 81.

The insulating body 10 comprises a central region 11 and two side branches 12 and 13 projecting therefrom, the branch 12 including keying means for physically preventing mis-assembling of the connector. The central region 11 comprises a plurality of contact elements 60 presenting a region 61 fixed in the central region 11 of the insulator body, a region 63 which pressfits in the mother card 1, and a male contact region 62 projecting from a connector face 31 of the central region 11.

The central insulating body 81 presents contact elements 85 having a female contact region 83 disposed within the body back from the connector face 41 and a pressfit region 88 making the connection with the daughter card 2. The elements 85 are bent at an angle in a rear insulating zone 891 of the insulating body 81. A centering and mounting peg 20 is borne on the side face 82 of the insulating body. 81 and enables one end 25 of the daughter card 2 to be secured to the central insulating body 81. A recess 16 is disposed in the outermost part 17 of the branch 12 and accommodates the end of the peg 20.

Figure 2:
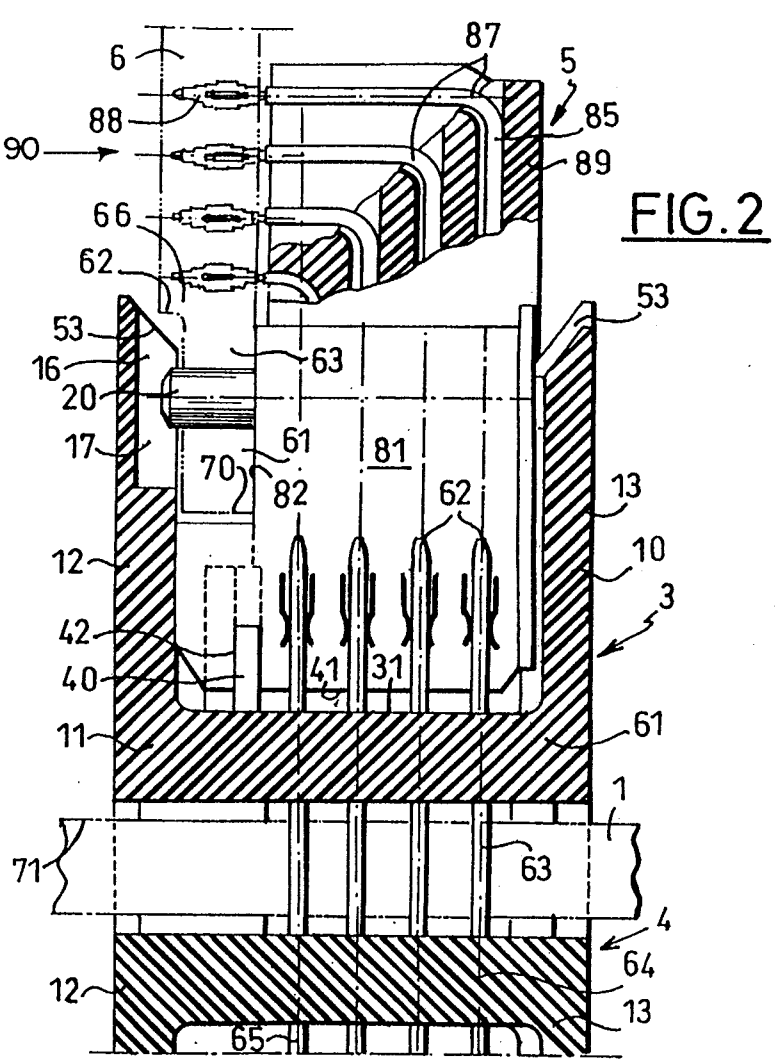
FIG. 2 is a similar view of a first embodiment of the invention.

FIG. 2 represents a connector assembly in accordance with the invention and which enables the use of a daughter card 6 of greater thickness.

One or more grooves 42 of the insulating body 81 are provided and a spacer member 40 is fitted therein.

More generally, such a spacer member 40 may be fitted in the central insulating body 81 or fitted in the central region 11 of the male connector part insulator, so that, when the connectors 3 and 5 are assembled together, their faces 31 and 41 are spaced apart. This enables a longitudinal predetermined space to be defined between the two connectors 3 and 5 when assembled together, so that the full thickness edge 62 of the daughter card 6 is spaced apart from the outermost end 53 of the arm 12. The position of the edge 70 of the daughter card remains unchanged relative to the insulating body 10.

In the drawings, the reduced thickness edge of the daughter card 6 is shown at 61. The inner part 63 of the reduced thickness end 61 is joined to the full thickness edge 66 of the daughter card 6 by a profiled section 62. The full thickness edge 66 is situated in the immediate proximity of the row 90 of contacts 88 and adjacent to the end 53 of the arm 12. The spacer 40 therefore enables the row 90 of contacts 88 to be disposed in a full thickness region of the daughter card 6 and as close as possible to the outer edge (which is chamfered in this example) of the branch 12.

It will also be noted that it is preferred to use the insert spacer 40 as a keying or physical check means also (preventing incorrect assembly). Such insert physical check elements are known, in particular from European patent application EP 0 392 629 (VAN WOENSEL). In addition, such a spacer is compatible with the recesses such as 42 in the connector insulator (FIGS. 2 to 4).

An insert spacer 40 enables a standard connector set to be adapted readily to different thicknesses of daughter cards. Moreover, as indicated above, it may, if desired, also fulfill the function of physical check, which gives considerable flexibility of use at reduced cost.

Figure 3:
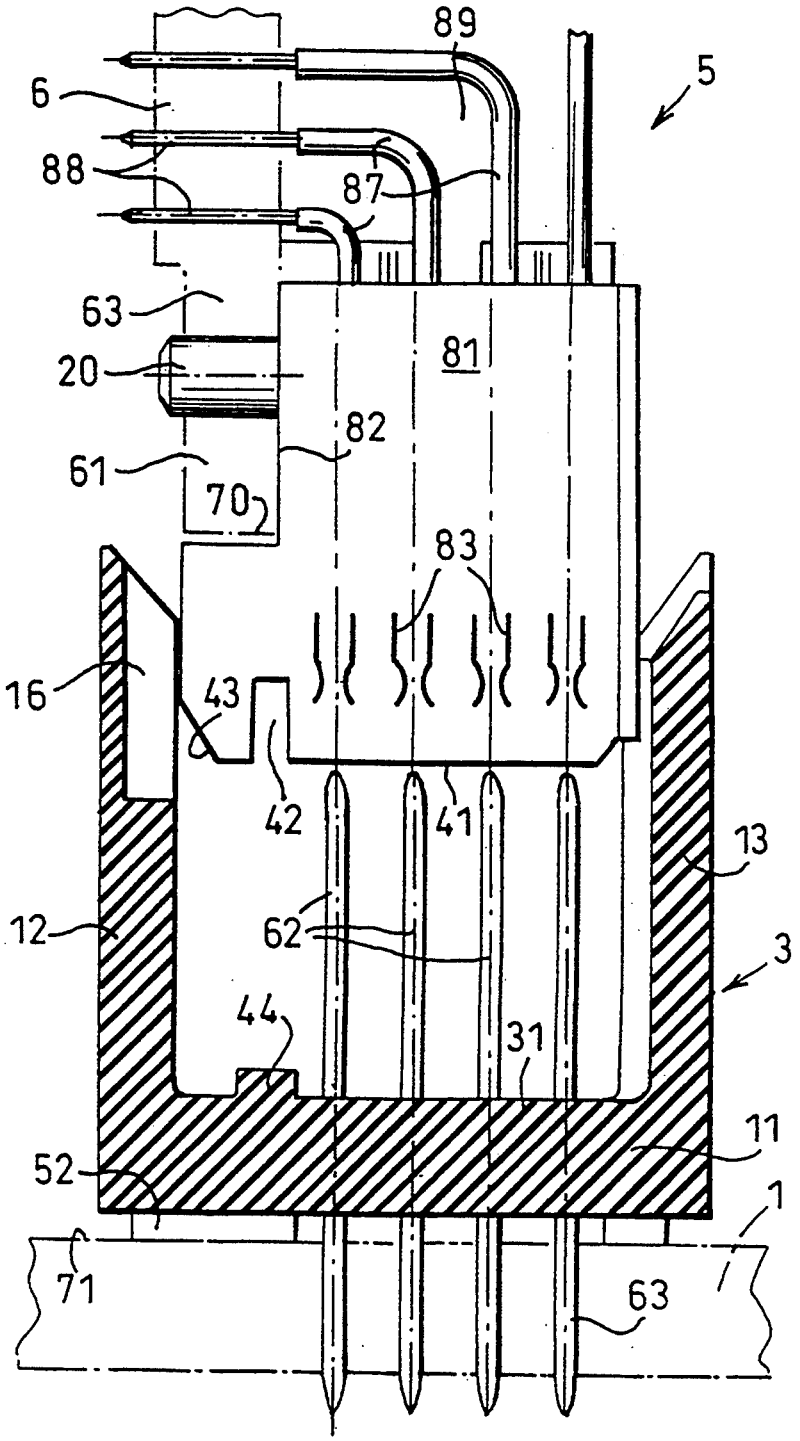
FIGS. 3 and 4 are similar views of a second embodiment of the invention, respectively before and after connection
Figure 5:
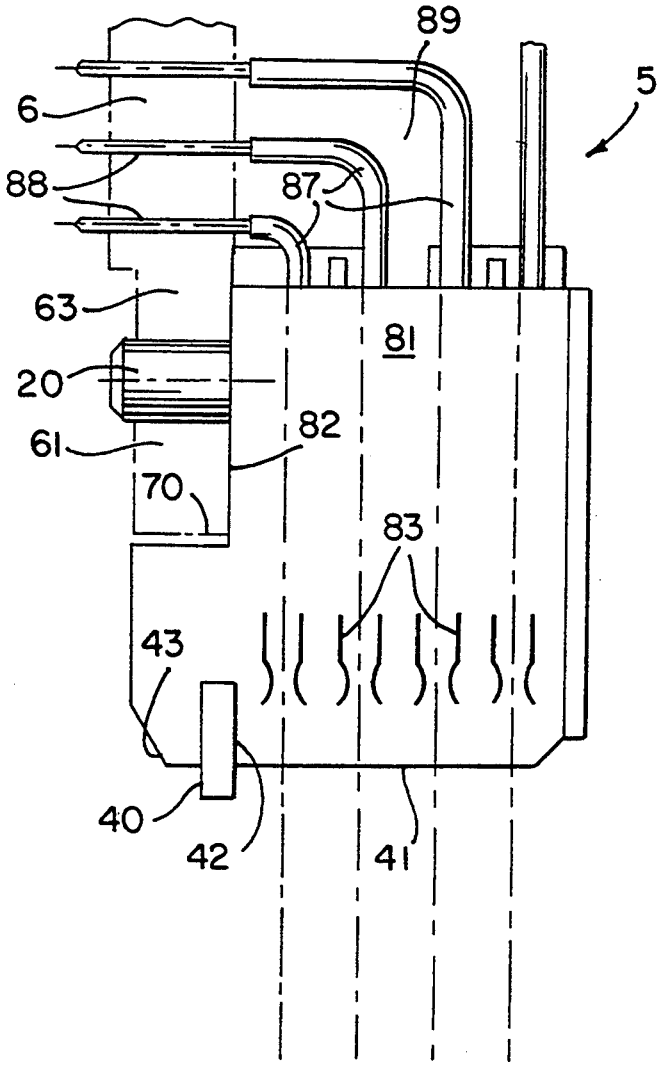
FIG. 5 is a side view of an element of the first embodiment of the invention.

In the example shown in FIGS. 3 and 5, the spacer member 44 is an integral part of the central region 11(or of the central insulating body 81). In this case, the complete connector is in principle suited for a maximum thickness of the daughter card 6. It is also possible, however, to add a removable insert spacer in order to adapt the connector to other thicknesses of the daughter card 6.

Figure 4:
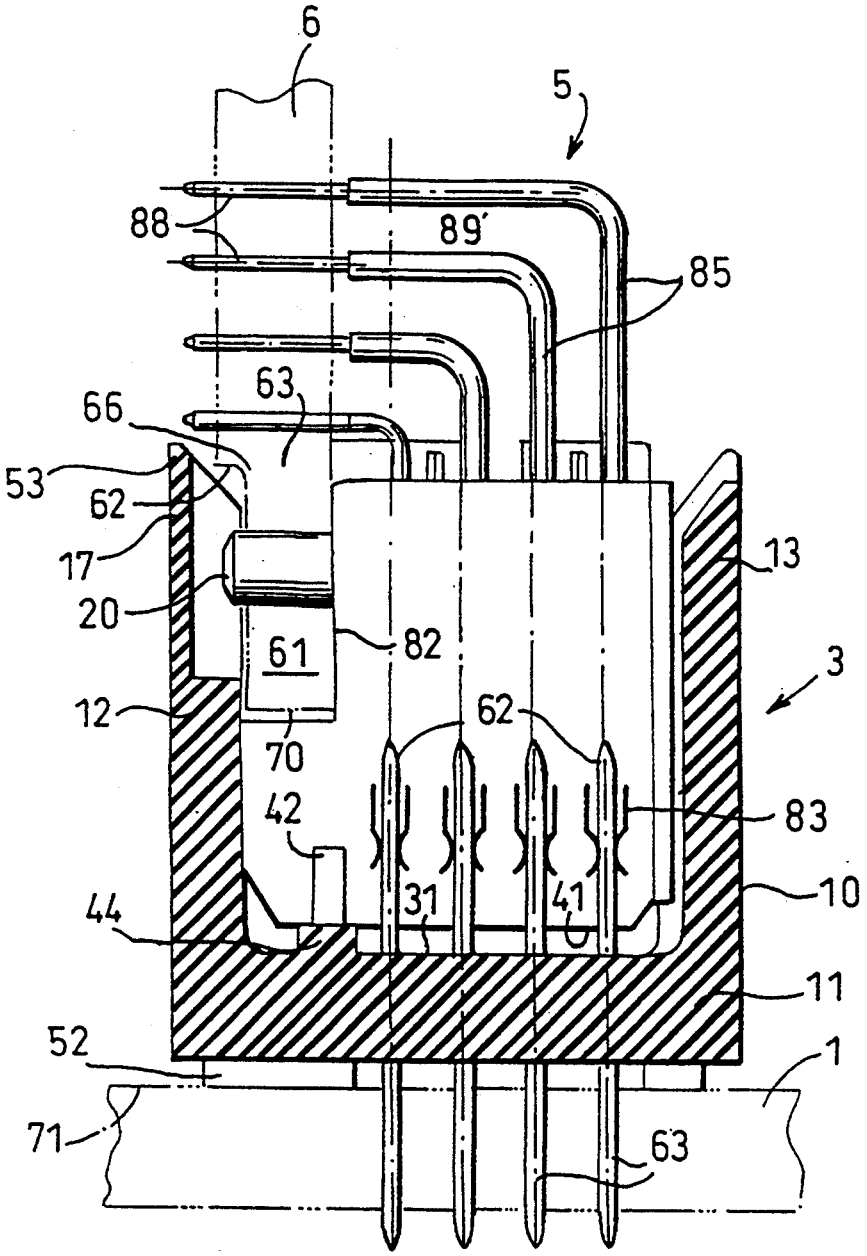

From FIGS. 1 to 4, it will also be seen that the distance between the extreme edge 70 of the card 6 and the reference surface 71 of the card 1 when the card 6 is fitted in the connector, is the same standard dimension in the prior art case of FIG. 1 for thicknesses of the card 2 up to 2,4 mm, and in the embodiments of the present invention shown in FIGS. 2 to 4 for thicknesses of the card 2 of 3,2 mm.

We claim:

1. A connector set for connecting a mother circuit board (1) to a daughter circuit board (2), said daughter circuit board having an edge portion (61) which may be of reduced thickness with respect to an adjacent thicker portion of said daughter circuit board, said connector set comprising:

a first connector member (3) including a first insulating body (10) having first contact elements (60) with first ends (63) suitable for insertion in the mother circuit board and having second ends (62), said first insulating body having two spaced lateral branches (12,13) with a central part (11) therebetween;

a second connector member (5) mounting said daughter printed circuit board at said edge portion, said second connector member comprising a second insulating body (81) suitable for being received in said first insulating body between said spaced lateral branches along a direction of insertion, said second connector member having second contact elements (85) with first ends (83) adapted to engage with respective second ends (62) of corresponding ones of said first contact elements (60) when said second insulating body is received in said first insulating body, thereby to connect said first and second connector members together, said second contact element and said first contact elements being formed to maintain the engagement of said first and second ends over a predetermined distance along the direction of insertion, said second contact elements having second ends (88) adapted to be inserted in the daughter circuit board, said first and second insulating bodies having respective, generally planar surfaces (31,41) transverse to the direction of dimension and which face each other when said second insulating body is received in said first insulating body, a portion of said central part (11) of said first insulating body forming one of said surfaces (41); and spacer means (40,44) located on ode of said facing surfaces said spacer means having an end defining a maximum spacing dimension thereof, said spacer means establishing a predetermined spacing gap between said facing planar surfaces of said first and second insulating bodies by the abutment of the other of said facing planar surfaces with said end of said spacer means;

one of said lateral branches of said first insulating body having an outer end (17) with a recess disposed on the internal face of said lateral branch that faces the edge portion of said daughter circuit board when said second insulating body is received in said first insulating body, said predetermined spacing gap between said facing surfaces being of a magnitude less than said predetermined distance along said direction of insertion so that the connection of said first and second elements is maintained and being such that said adjacent portion of said daughter circuit board is disposed in immediate proximity to said outer end of said one lateral branch, thereby to allow said second insulating body and said edge portion of the daughter circuit board mounted on said second insulating body to be received in said first insulating body.

2. A connector set according to claim 1 characterized in that said spacer means comprises an insert member (40) in said one of said planar surfaces of said insulating bodies (11, 81).

3. A connector set according to claim 1 characterized in that said spacer means comprises at least one projection (44) which is an integral part of said one of said planar surfaces (31, 41).

4. A connector set according to claim 1 characterized in that said adjacent thicker portion (66) of aid daughter circuit board is disposed in immediate proximity to said second ends (88) of said connection elements (85).

5. A connector set according to claim 1 characterised in that said first connector member (3) is a male connector and said second connector member (5) is a female connector.

6. A connector set according to claim 1 characterized in that a lateral face (82) of said second insulating body (81) has means (20) for mounting said edge portion of the daughter circuit board on said second insulating body.

7. A connector set according to claim 6 characterized in that said adjacent bicker portion of said daughter circuit board (66) is disposed in immediate proximity to said second ends (88) of said second connection elements (85).

* * * * *